United States Patent [19]

Mertes

[11] Patent Number: 4,827,569

[45] Date of Patent: May 9, 1989

[54] FLUSH MOUNTED, FULLY CONCEALED CABINET HINGES

[76] Inventor: Paul M. Mertes, 15528 Don Metz St., Mission Hills, Calif. 91345

[21] Appl. No.: 181,196

[22] Filed: Apr. 13, 1988

Related U.S. Application Data

[63] Continuation-in-part of Ser. No. 893,043, Aug. 1, 1986, Pat. No. 4,736,491.

[51] Int. Cl.[4] ..... E05F 1/08; E05D 3/06; E05D 15/32

[52] U.S. Cl. ..... 16/288; 16/302; 16/358; 16/360; 16/368

[58] Field of Search ..... 16/288, 302, 358, 360, 16/361, 364, 368, 369, 370

[56] References Cited

U.S. PATENT DOCUMENTS

| | | | |
|---|---|---|---|
| 2,320,772 | 6/1943 | Doman | 16/358 |
| 3,038,196 | 6/1962 | Nyquist | 16/358 |
| 3,673,635 | 7/1972 | Cencioni | 16/358 |
| 4,736,491 | 4/1988 | Mertes | 16/358 |

*Primary Examiner*—Fred A. Silverberg
*Attorney, Agent, or Firm*—Poms, Smith, Lande & Rose

[57] ABSTRACT

A flush mounted hinge assembly for use in applications where the hinges are to be fully concealed and where the doors abut one another or an adjacent structural member, includes a cabinet mounted bracket, a door mounted bracket, and a housing pivotally mounted to the cabinet bracket. The movement of the door accomplished in two stages, with initial pivoting being handled by a parallelgram-type linkage interconnecting the housing with the door mounted bracket, and permitting initial outward movement of the door to clear the adjacent door or abutting cabinet structure. Subsequently, as the door opens wider, a control member attached to the parallelogram linkage permits relative movement of the housing and the cabinet mounted bracket member, to permit full pivoting of the housing relative to the cabinet bracket, under control of a cam and cam follower linkage associated with the parallelogram mounting, following initial restraint of the housing against pivoting while the door is at a relatively small angle relative to the cabinet. To permit final movement of the door at angles between 90 degrees and 180 degrees, the pivot point of at least one of the parallelogram members may be permitted to shift, while the entire door continues to rotate to an additional angular orientation. The pivot point is arranged so that at limited angles is restrained from any lateral shifting, whereas beyond a certain angular orientation, the pivot point may shift laterally.

19 Claims, 8 Drawing Sheets

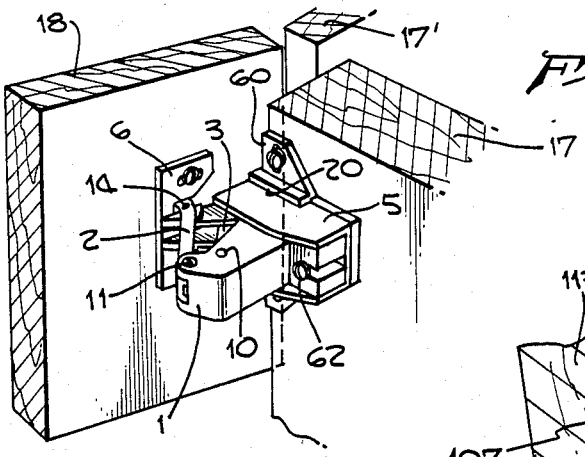
Fig. 1.
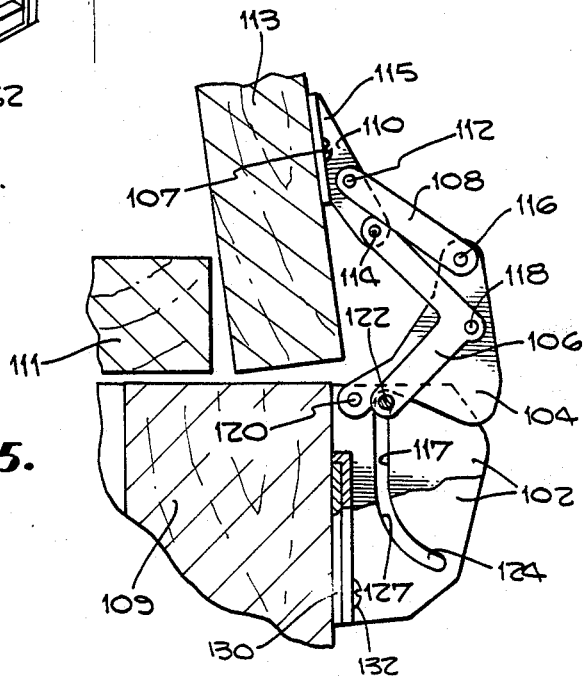
Fig. 15.
Fig. 14.
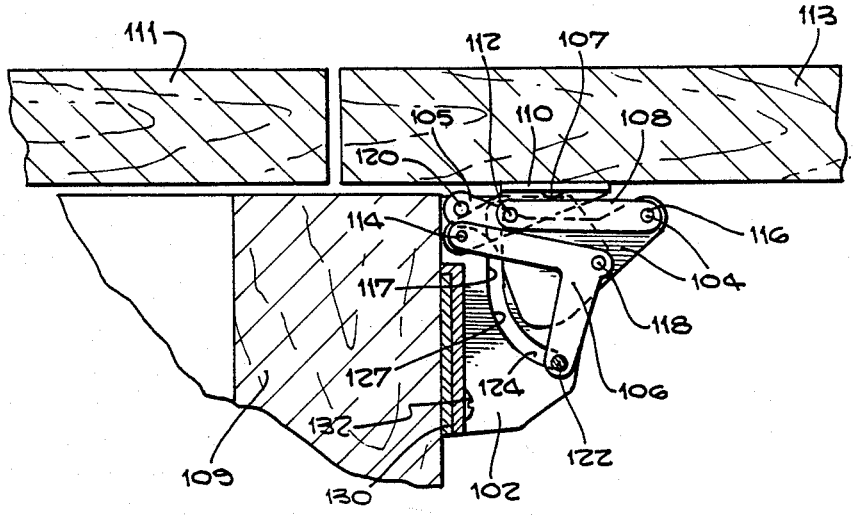

Fig. 8.
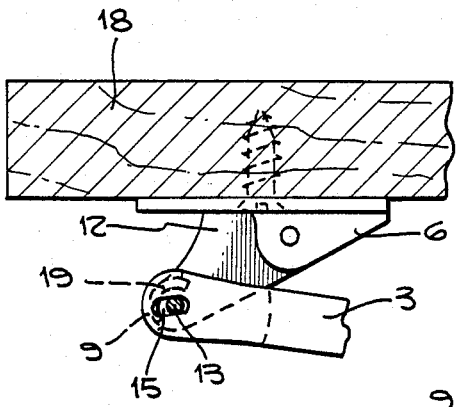
Fig. 11.
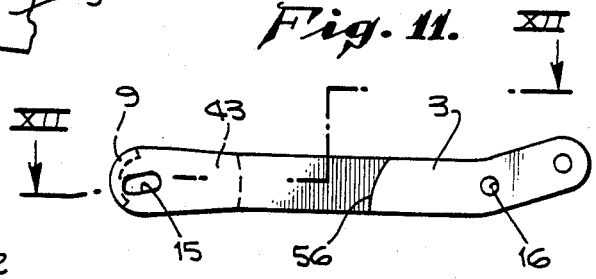
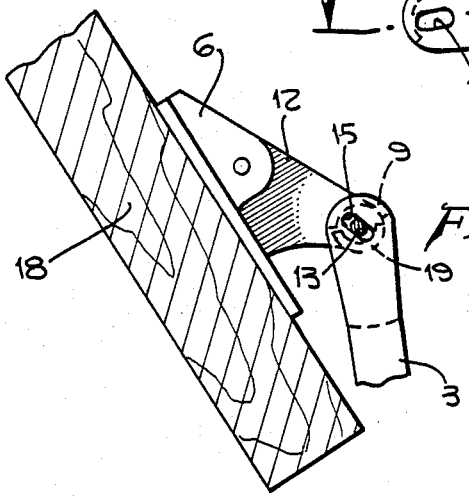
Fig. 9.
Fig. 12.
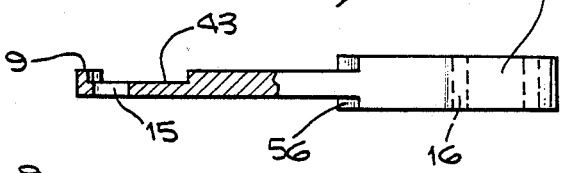
Fig. 10.
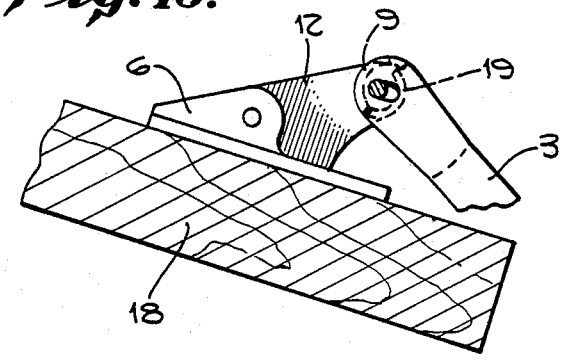
Fig. 13.
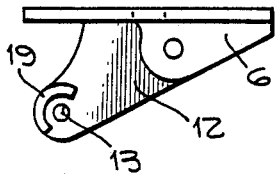

FIG. 22
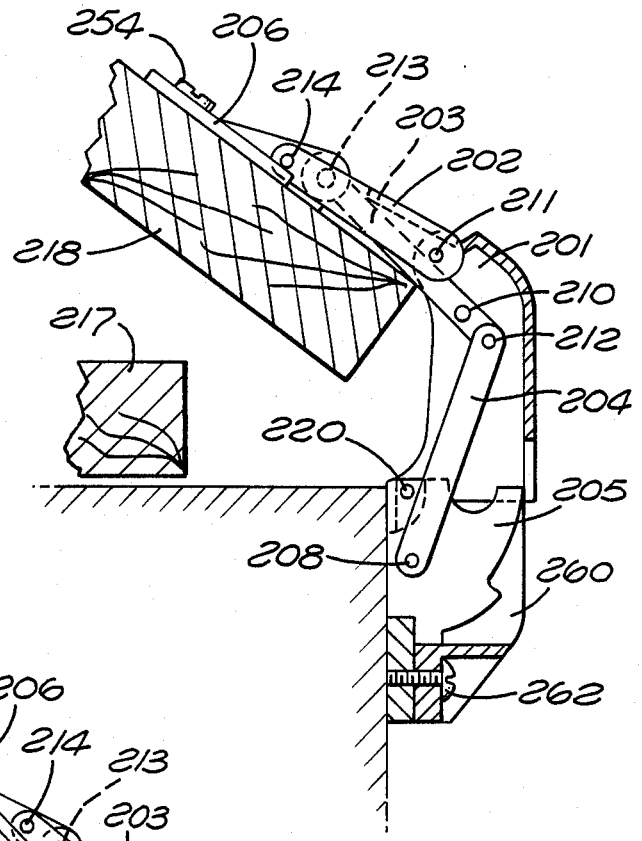
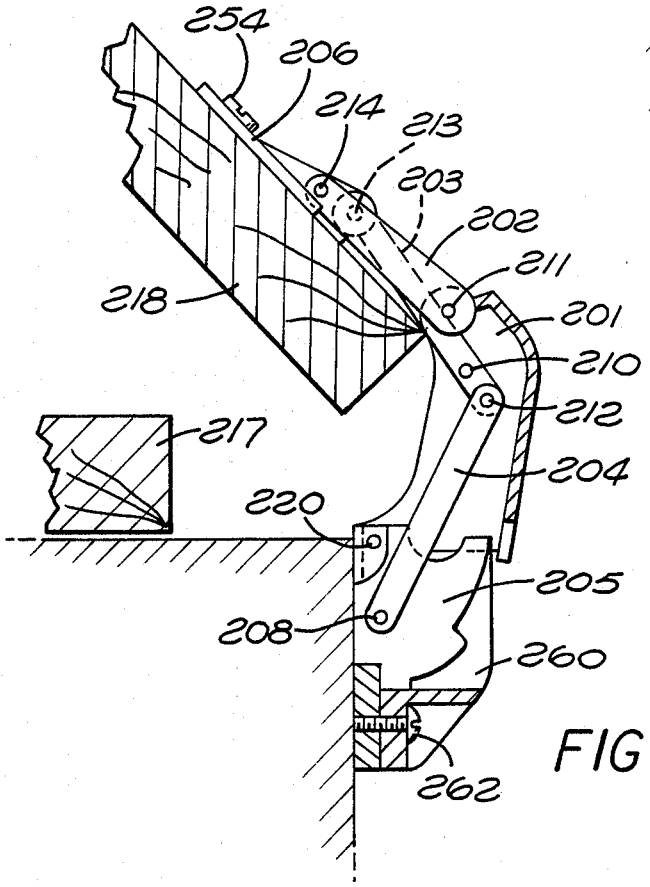
FIG. 23

FLUSH MOUNTED, FULLY CONCEALED CABINET HINGES

RELATED PATENT APPLICATIONS

This patent application is a continuation-in-part of U.S. patent application Ser. No. 893,043, filed Aug. 1, 1986, now issuing as U.S. Pat. No. 4,736,491, issuing Apr. 12, 1988.

The embodiments of FIGS. 1 through 15 are included in the parent patent, and the embodiments of FIGS. 16 through 27 have been added in this case.

FIELD OF THE INVENTION

This invention relates to fully concealed hinges for cabinets or the like, including applications where the hinged edge of a cabinet door abuts another door or a rigid structural member.

BACKGROUND OF THE INVENTION

In previous fully concealed hinge designs, whether these hinges were of the 90 degree opening type or of the type having a full opening angle of 165 degrees or more, there has been the necessity of machining the door to receive the hinge. This machining process involved either cutting a slot near the edge of the door or boring a rather large diameter, deep hole. These hinges were known as the "32 millimeter system" or the European type of cabinet hinge. In addition to the large hole being required in the door, this type of installation also required three different thicknesses of mounting plates to accommodate the different amount of door overlay relative to the cabinet. There are about four different types of European hinges for the 90 degree to 120 degree hinges. Also, there are special European-type hinges required for doors that are $\frac{7}{8}$ inch to one and one-quarter inches thick.

Patents disclosing the European type of fully concealed hinge and illustrating the points mentioned above, include U.S. Pat. No. 3,626,548 to H. Grunert; U.S. Pat. No. 3,863,292 to H. Grunert, et al.; and U.S. Pat. No. 3,978,549 to T. Vitt. Attention is also directed to N. H. Nyquest U.S. Pat. No. 3,038,196, granted June 12, 1962, which shows an intermediate, slot mounted plate, and associated linkage, which patent was cited in the parent case.

A principal object of the present invention is to provide a fully concealed hinge which will avoid the problems and shortcomings of the prior art hinges as outlined hereinabove.

SUMMARY OF THE INVENTION

In accordance with the present invention, a fully concealed type hinge includes a first flush mounted member or bracket for mounting to the cabinet, a second flush mounted member or bracket for securing to the cabinet door, a housing or main structural member having a fixed pivot point on the cabinet mounted bracket, and parallelogram-type mounting members for pivotally intercoupling the housing with the door mounted bracket. The pivoting of the housing about the cabinet member is controlled by a linkage connected to the parallelogram mounting members to restrain the housing against pivotal movement until the door has shifted in position a substantial distance away from the cabinet, and to thereafter force rotation of the housing relative to the cabinet mounting bracket to accommodate wide open pivoting of the cabinet door.

Collateral aspects of the operation of one embodiment of the hinge include initial actuation of the parallelogram members while the door is close to the cabinet, subsequent substantial locking up of the parallelogram, members, and continuation of the movement of the door by rotation of the housing relative to the cabinet mounted bracket.

For wide opening doors, shifting of the pivot point of at least one of the parallelogram members is facilitated at one range of angles only, of the orientation of the parallelogram members relative to the door mounted bracket or the housing.

Camming arrangements for intercoupling the housing and the cabinet mounted member may be used for controlling the degree of pivoting of the housing relative to the cabinet mounted member, under the control of the linkage coupled to the parallelogram type members.

With regard to the advantages of the present invention, the new hinge does not require any machining of either the cabinet door or the cabinet, but the hinges are simply flush mounted. The new hinge will accommodate doors of any overlay, up to approximately $\frac{7}{8}$ inch, and will also accommodate flush doors and lip style doors. Incidentally, there is currently no known hinge of the so-called European or 32 mm style hinge which can accommodate lip style doors.

It is further noted that the new hinges are smaller in size than the prior European style hinges and have good structural qualities. Only two hinge models would be required to handle all door angle opening requirements, and different mounting plate thicknesses would not be required.

As mentioned above, FIGS. 16 through 27 are new with this continuation-in-part application. One significant advantage in the new design permits wider opening without the shifting pivot point described in the parent case. This is accomplished in part by locating the door mounted pivot points of the two parallelogram linkage members substantially in the same plane, parallel to the face of the door. In addition, when the door is closed, the two linkage members are slightly angled away from the door, from the hinged edge of the door, where the linkages are pivotally mounted to the door bracket.

Also included in the newly added subject matter is an improved and simplified single screw mounting arrangement, and a self-closing spring mechanism.

Other objects, features, and advantages will become apparent from a consideration of the following detailed description and from the accompanying drawings.

BRIEF DESCRIPTION OF THE DRAWINGS

FIG. 1 is an isometric view of a flush mounted, fully concealed hinge illustrating the principles of the present invention;

FIGS. 8 through 13 are detailed showings of certain particular parts of the hinge of FIGS. 1 through 7, with these showings serving to bring out certain additional features of the invention;

FIG. 14 is a partial cross-sectional view of another embodiment of the invention wherein the hinge is only operative to permit approximately 90 degrees or slightly more of an opening angle of the door; and FIG. 15 is a partial cross-sectional view similar to that of FIG. 14, but with the door shown in the open position;

FIGS. 22 and 23 show two slightly modified embodiments of the invention;

DETAILED DESCRIPTION

Figure 2:
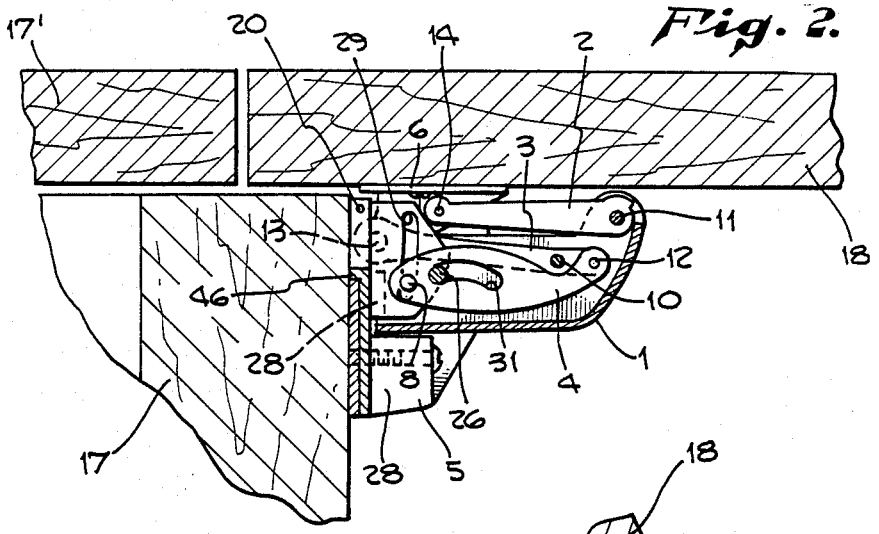
FIG. 2 is a partial cross-sectional view of the hinge of FIG. 1, with the door in the closed position.

As noted above, FIGS. 1 through 15 were included in the parent case, and the description of these figures will now be set forth as in the parent case, and then new FIGS. 16 through 27 will be described.

Referring more particularly to the drawings, FIGS. 1–13 show one embodiment of the invention, and FIGS. 14 and 15 illustrate another embodiment thereof; and it should be particularly noted that FIG. 1 relating to one embodiment is on the same drawing sheet with FIGS. 14 and 15 relating to the other embodiment.

Now, before going into the detailed construction, a few overall statements of the mode of operation may be useful. First, we have flush mounted bracket 6 secured to the door 18 and flush mounted bracket 60 and associated part 5 secured to the cabinet 17. The housing 1 is pivotally mounted to the part 5 at the fixed pivot point 20. The part 6 secured to door 18, is mounted with a substantial parallelogram type mounting to housing 1 by the two arms 2 and 3, with the critical pivoting movement of housing 1 being controlled by part 4, which is linked to arm 2 at pivot point 12.

With this arrangement, the door 18 initially moves outward substantially under the control of the parallelogram linkage, with the main structural member 1 pivoting very little. Then, once the door clears the adjacent cabinet 17 or adjacent fixed door structure 17', the linkage 4 is actuated by arm 3 to cause part 1 to pivot, thereby permitting the door to swing wide open.

We will now return to a more detailed, step-by-step consideration of the structure.

Specifically, referring to FIGS. 1–13, when the door 18 is starting to be opened, the part 6 attached to door 18 will actuate the two arms 2 and 3. They are pivotally attached to part 6 by rivets 13 and 14 and to part 1 by rivets 10 and 11. Incidentally, part 2 is U-shaped, with two arms, one of which may be seen in FIG. 1, on either side of part 3 (see FIGS. 11 and 12), and with the open part of the "U" facing the door mounted bracket 6. The parts 2 and 3 are initially substantially parallel to the face of the cabinet, as shown in FIG. 2 of the drawings, and are pivotally secured to part 6 near the edge of the door, and to part 1 at the ends of arms 2 and 3 away from the edge of the door 18. These four parts 1, 2, 3 and 6 form a parallelogram type of linkage with part 6 being rotated in an arc away from the face of the cabinet and the adjacent door 17', and with part 6 making progressive angle with the face of the cabinet.

The opposite end of part 2 which extends beyond pivot point 10 is attached to part 4 by rivet 12, and as part 2 rotates, the end of part 4 attached to end of part 2 is radiused in a downward direction, as shown in FIG. 2, and then towards the cabinet 17. There is no significant movement of part 4 toward the pivoted end of part 1 at first and this allows the arms 2 and 3 with attached part 6 to travel upward and to the right as shown in FIG. 2 thereby assuring that the edge of door 18 will not engage door 17' as door 18 opens. The other end of part 4 is slidably and pivotally attached to the channel 29 portion of fixed part 28, and as part 4 is displaced toward the pivot end of part 1, the housing 1 will start to rise as shown in FIGS. 2 and 3, rotating about the rivet 20 of part 5.

Figure 3:
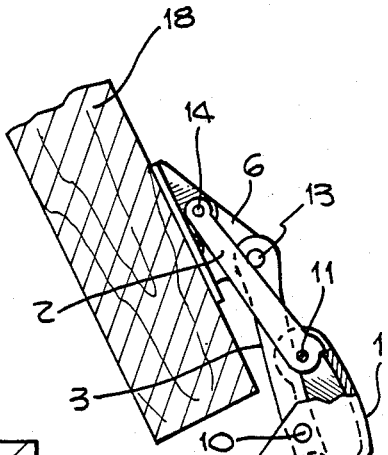
FIG. 3 is a cross-sectional view similar to that of FIG. 2, but with the door opened slightly beyond 90 degrees.

This rotation of parts 2 and 3 in relation to part 1 and the rotation of part 1 in relation to part 5 will continue until the parts are as shown in FIG. 3 where part 1 is about 60 degrees to the vertical and the door 18 has rotated about 120 degrees. As can be seen, there is a somewhat horizontal channel 31 in part 4 that curves downward toward the right end thereof (see FIGS. 2 and 3) and there is a pin 26 that is attached to the side of housing 1, with pin 26 being situated at the left end of part 4 before part 4 has started to move. Now, as the right-hand end of part 4 is moved downward relative to housing 1, the left-hand end of part 4 which is pivotally and slidably mounted in the channel 29 of part 28 will be forced to move upward in the channel 29, as part 4 moves further downward relative to part 1. The curved portion of channel 31 will reach the pin 26 and the end of part 4 attached slidably to channel 29 of part 28 will rise further upward where it would finally appear as in FIG. 3.

Figure 5:
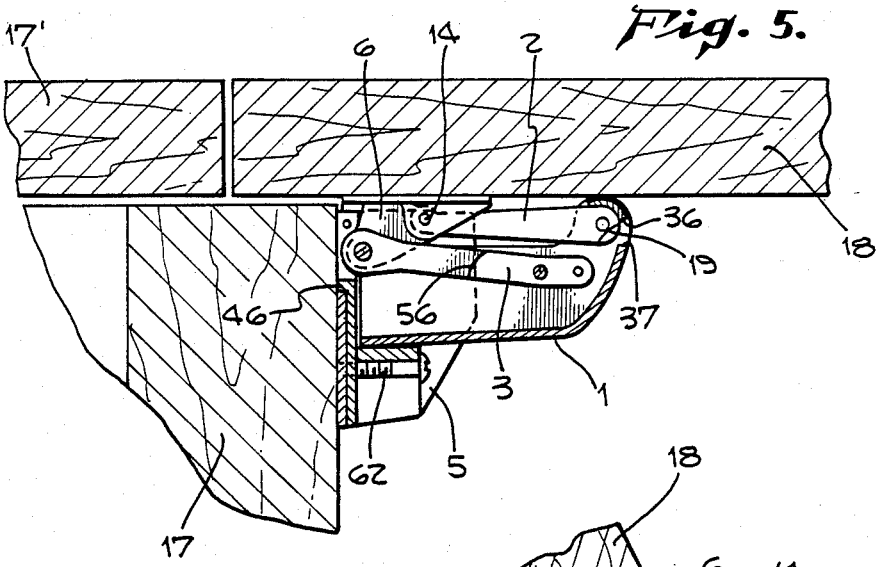
FIG. 5 is another partial cross-sectional view with the door closed as in FIG. 2, but with certain parts deleted, to more clearly show some of the underlying constructional features.
Figure 6:
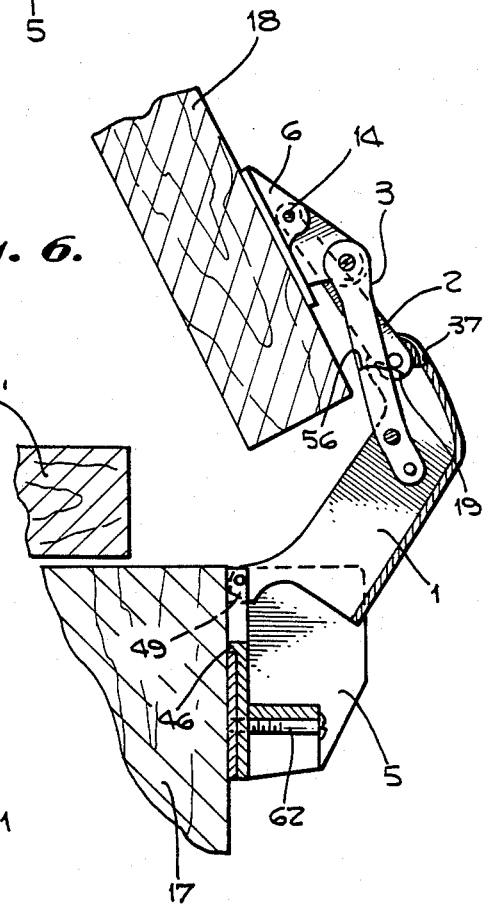
FIGS. 6 and 7 are similar to the showings of FIGS. 3 and 4, respectively, of the drawings, but again with certain of the parts being deleted to more clearly show the crucial mating and lockup of the parallelogram type parts.
Figure 7:
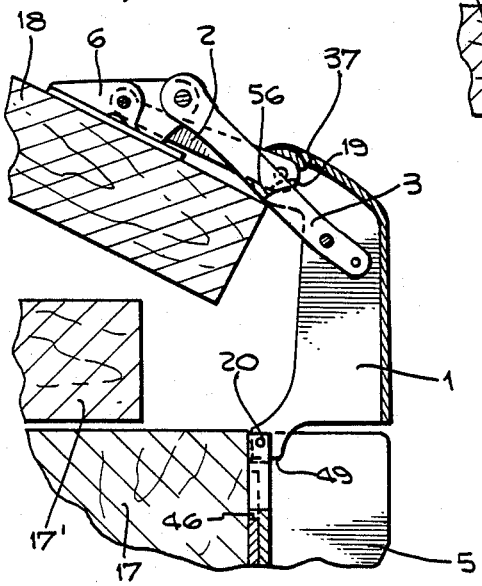

Just before the parts have obtained the position shown in FIG. 3, the cam faces 56 of part 3 shown in FIGS. 11 and 12 will have engaged two matching inclined faces 19 just inside the outer faces of part 2, see FIGS. 5, 6 and 7. In these three views the front one-half of U-shaped part 2 has been removed, so that the leg on the opposite side can clearly be seen, showing the inclined face 19 and how the face portion 56 of arm 3 engages this face in a sliding manner as part 3 rotates further open. There is an abutting face portion 36, part 2, FIG. 5 that has now come up against an abutting surface 37 of part 1. FIG. 5. Now, since the faces 56 of part 3 are engaged with the inclined faces 19 of part 2, and part 2 has rotated as far as possible and has abutted against part 1, part 2 is in a rigid locked condition relative to part 1. Just before the position of parts shown in FIG. 3, when points 14-13-11 of the parts are in an approximate straight line, the pivot point 13 where part 1 joins part 6 becomes a sliding or expanding pivot point.

Referring to FIGS. 8 through 13, the operation of this expanding joint will now be reviewed. As can be seen in FIG. 13, part 6 has a raised semi-circular portion 19 that is above the surface 12 of part 6. Now, referring to FIGS. 11 and 12, there is a recessed area 43 at one end of part 3, and there is a slot or channel 15 and a raised semi-circular portion 9 adjacent the slot 15. In FIGS. 8, 9 and 10, a portion of part 3 has been removed and the slot 15 superimposed to show the relationship of the different surfaces. In FIG. 8 it can be seen how the raised portion 9 of part 3 comes into contact with the outside surface of the portion 19 of part 6. It can also be seen how the rivet 13 is at the right hand end of slot 15. As can be seen, part 3 can rotate about rivet 13, with the circular raised portion 9 of part 3 rotating clockwise around the outside surface of raised portion 19. This will continue until the end of portion 9 of part 3 clears the end of the semi-circular part 19, which happens at about the time that the rivets 11-12-14 of parts 2-3-6 are lined up. FIG. 9 shows how the portions appear when rivet 13 has risen above the line of rivets 11 and 14 as shown in FIG. 3. As can be seen in FIG. 9, the rivet 13 is now about midway in the slot 15 of part 3. Now, as the door 18 opens farther, the end of part 3 attached to part 6 will rise above the rivets 11 and 14.

Figure 4:
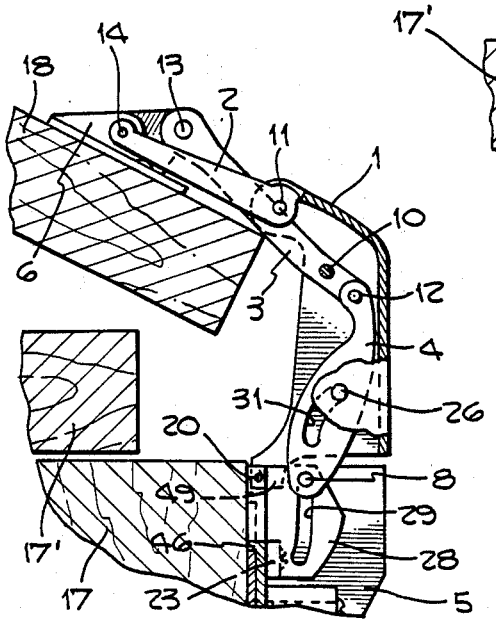
FIG. 4 is an additional view similar to that of FIGS. 2 and 3, but with the door shown in a wide-open position approaching 180 degrees.
Figure 4:
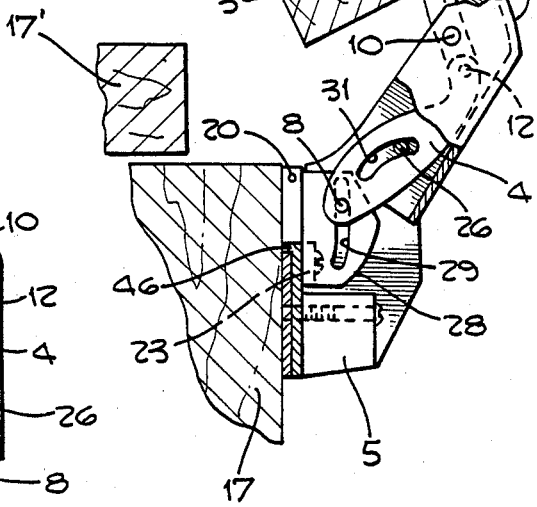

The downward curving portion of the channel 31 will have reached the pin 26 of part 1, and as the door is opened further part 1 will be forced even further into the vertical position. The rivet 8 of part 4 in channel 29 of part 28 will come into contact with the foreward face of channel 29 of part 28 and this will force the end of part 4 upward and toward the rear of part 1. The movement of part 4 toward the rear of part 1 will also be assisted by the rotation of part 3 about rivet 10 as part 6 imparts force to the end of part 3 while rotating to its final opening angle. As part 1 rotates toward a vertical position the curved portion of channel 31 will have cammed against pin 31 and pin 26 wil not be almost to the end of channel 31 and the parts 2, 3 and 6 will soon be in a rigid fixed position relative to part 1. The part 6 and attached door will continue rotating until part 6 is parallel to part 2 as seen in FIG. 4. The cam faces 56 of part 3 have slid further on the faces 19 of part 2 and part 1 has now rotated to a vertical 90 degree position, as shown in FIG. 4.

The pin 26 secured to housing 1, FIG. 4, is now at the right hand end of the channel 31 of part 4, the rivet 8 of part 4 has reached the top of the channel 29 of part 28, and the rivet 13 of part 6, FIG. 3, is now at the opposite end of the slot 15 of part 3, and the semicircular portion 9 of part 3 has moved closer to rivet 13. The face portions 49 of part 1, FIGS. 6 and 7, have come into contact with a flat abutting surface 46 of cabinet bracket 5, preventing part 1 from rotating or being forced any further in the counterclockwise direction, as shown in FIG. 7. The rivet 8 of part 4 at the top of channel 29 of part 28 also helps in this regard, see FIG. 4. The door 18 is now in a rigid fixed position in relation to parts 2, 3, 6 and 1. Part 3, which controls parts 2 and 6, is held in a stationary position by part 4 which is now in a fixed position held by rivets 8 and 26 in channels 29 and 31, respectively. As the door is being shut again, the hinge will start to close, with part 1 initially starting to rotate clockwise about rivets 20 of part 5, thereby rotating the door 18 away from door 17' and then allowing the parts 2, 3, and 6 to start rotating the door 18 about part 1.

For door adjustments in a horizontal or left and right direction slots have been provided in the mounting holes for part 6, see FIG. 1. For vertical adjustments there are mounting slots in the mounting plate 60 to which part 5 is secured by screw 62 and flanges extending along part 60 on each side of part 5. For front to back adjustments the screw 62 which holds part 5 to the plate 60 can be loosened and the door moved, and the screw 62 then retightened. Once the door has been adjusted on the cabinet the screw which holds the part 5 to the mounting plate 60 can be loosened and the hinges and attached door can then be slid off of the mounting plates and shipped separately, thereby avoiding damage in shipping and facilitating installation of cabinets.

An alternative embodiment of the invention which opens slightly more than ninety degrees will now be considered. More specifically, FIG. 14 shows this hinge in a closed position and FIG. 15 shows the hinge in a wide open position. As can be seen in FIGS. 14 and 15, part 102 consists of two side portions and an interconnecting back piece, not shown. The front side portion has been removed so interior details can be seen more clearly. The part 102 has a mounting plate with slots to fasten the hinge to the cabinet 109, similar to the arrangements shown for parts 5 and 60 in FIG. 1.

There is a curved groove 127 in the side of part 102. Part 102 is die cast and the groove is part of the casting. The curved groove 127 has a radiused portion 124 starting at the bottom right-hand corner as shown in FIGS. 14 and 15 and continuing through about 60 degrees of angle. At this point, it changes into a straight line 117 going in a vertical direction. This straight line portion ends about ⅛ inch down from the top edge of part 102. Part 104 is a stamping consisting of two side portions and a frontal piece connecting the two side pieces. In FIGS. 14 and 15, one side portion has been removed to show the interior details. Part 104 is riveted to part 102 by two rivets 120. Part 108 has two elongated side portions and a top portion near the end connecting the two side portions. Part 108 fits inside of part 104 and connects to part 104 by a rivet 116 that passes from one side to the other. Flush mounted door bracket 110, secured to door 113, has the end of arm 108 pivotally secured to it by a through rivet 112. Part 11U consists of a flat base portion that fastens to the door 113 by screws 107. There is a perpendicular upstanding portion 115 to which the end of part 108 fastens with a through rivet 112. The outwardly extending end of part 110 is reduced in thickness by the width of part 106 to allow L-shaped arm 106 to enter and be fastened to part 110 by the through rivet 114. Part 110 is formed by die casting. Part 106 is an L-shaped stamping. Port 106 is fastened to part 104 by rivet 118, part 106 being pivotally secured to the center of part 104. Parts 106 and 108 form a parallelogram type linkage between part 104 and the door bracket 110, whereby part 104 initially remains fixed, while door 113 is rotated out from the cabinet and away from adjacent door 111.

The lower end of the L-shaped port 106 has a pin 122 extending at right angles, approximately 3/22 inch to ⅛ inch, to fit into and make sliding engagement with groove 127 of part 102. The arm holding pin 122 is bent so as to be as near the slide portion of part 104 as possible. There is a slotted section on the front portion of part 104 for a short distance so the lower leg of part 106 may pass through it when part 104 is in a closed condition as shown in FIG. 14.

The operation of the hinge when the door is being opened will now be considered. As the door 113 is starting to be pulled open from its rest, closed position as shown in FIG. 14, part 110, pivotally connected to parts 108 and 106 by rivets 12 and 14, will rotate the part 108 and the horizontal arm of part 106 outwardly away from the cabinet. This action will shift the position of door 113 in an outward and rightward direction as shown in FIGS. 14 and 15, away from door 111, as mentioned above. As this is happening, pin 122 of the lower arm of part 106 will be moving to the left and is engaging the radiused portion 124 of groove 127. If there is any tendency for part 104 to rotate outward, it is prevented by the pin 122 in the radiused portion 124 of groove 127. Now, as the part 108 and the upper arm of L-shaped part 106 rotate further outward, the door bracket 110 is starting to rotate in a counterclockwise direction and the door 113 will start making an angle with the face of the cabinet 109. When the part 108 and the upper arm of part 106 reach an angle of about 60 degrees with the face of the cabinet 109 and the pin 122 secuted to the lower arm of part 106 reaches the straight portion 117 of groove 127, the pin 122 will start bearing against the rear face of portion 117 of groove 127. This pressure and the rotative effort exerted on part 104 through the door 113 and parts 110-108-106 will start to rotate the part 104 outwardly. This action will continue until pin 122 of part 106 has reached the top of the straight groove 117, and in so doing it will have rotated the upper arm of part 106 another 20 degrees to 30 degrees in relation to part 104. Arm 108 will also have rotated approximately the same amount, and door bracket 110 will have rotated in a counterclockwise direction to the position shown in FIG. 15, which is about 100 degrees relative to the face of the cabinet. Part 104 is prevented from rotating outward any further due to the pin 122 of part 106 coming to a stopped position against the end of the groove 127. Concerning a minor additional point, the bracket 102 is secured to mounting plate 130 by the screw 132.

In considering the two embodiments of the invention as described hereinabove, it may be noted that they have much in common. Thus, they both have flush mounted door and cabinet brackets and a main structural member or housing having a fixed pivot with respect to the cabinet bracket. They also both have parallelogram-type linkages intercoupling the door mounted bracket and the pivoted housing or main structural member, and control arrangements coupled to the parallelogram-type linkage for initially restraining the pivoted housing or main structural member against rotation, and subsequently guiding full rotation thereof as the cabinet door opens wider. In each case the parallelogram linkage arms are initially approximately parallel to the face of the cabinet and are pivoted to the door bracket at the ends of the linkage members closest to the edge of the door, and are pivotally mounted onto the main structural member or housing, at the ends of the arms away from the edge of the door. This insures that the initial movement of the door bracket is away from the adjacent abutting door or cabinet structure, and outward, with the door bracket and the door initially remaining substantially parallel to the face of the cabinet.

For completeness, it is noted that the cabinet mounted bracket may include more than one part, such as the parts 5 and 60 in FIG. 1, with one part being adjustable relative to the other.

Another version of the full opening hinge would be to have one end of the rivet 12 that attaches part 4 to part 3 follow a channel that would be an integral part of part 1 or a separate attached part. This channel would describe the same radius from rivet 10 as does rivet 12 rotating about rivet 10. When the rivets 11, 13, 14 of parts 2, 3 and 6 are lined up, the end of rivet 12 would contact an inclined portion of the channel and as the door is opened further and the pivot point at rivet 13 moves above rivets 11 and 14, the end of rivet 12 in the inclined channel portion would move the part 3 toward part 6; and the required distance would be in proportion to the distance pivot point 13 is above the rivets 11 and 14 of parts 1, 2, and 6. Part 3 would have a slot instead of a hole where rivet 12 attaches it to part 1. This slot would allow for the movement of part 3 caused by the end of the rivet 12 in the inclined portion of the channel. The end of rivet 12 could also have a small roller to reduce wear and friction in the channel. In this version the camming of parts 2 and 3 together to make part 2 rigid would not be required as in the first full opening version.

A simpler version would be a hinge that would only open to about 135 degrees and would be used primarily for lip-type door styles and spaced overlay door styles, where there is no door or surface abutting closely with the hinged door. In this hinge the pivot point 13 where part 6 and 3 are pivotally attached would not rise above the pivots 11 and 14 of parts 6, 2, and 1. A shifting pivot point would therefore not be needed. Part 4 could also be a simple link pivotally attached to the cabinet bracket on part 5, and the end of part 3. With this arrangement, channel 31 of part 4 and channel 29 of part 28 would not be needed.

As a further alternative, at least one of the parallelogram linkage members could be formed of two pivoted members which would, at door angles less than 90 degrees, for example, act like a single linkage member; but, at large angles, the two parts could be cammed to pivot relative to one-another, to permit a wider opening angle for the cabinet door.

The following description relations to the improved embodiments of the invention included in FIGS. 16 through 27, which were not included in the parent case.

Figure 16:
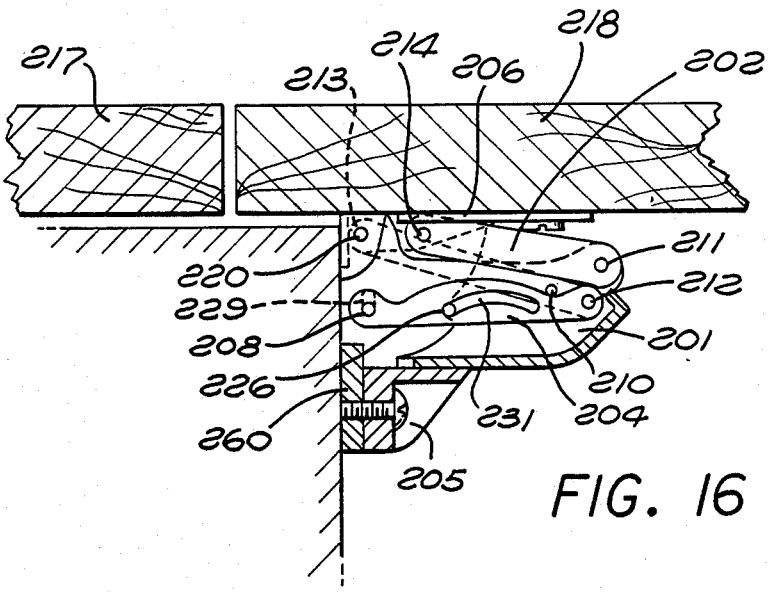
FIG. 16 is a partially cut-away cross-sectional view of an improved version of the hinge, showing the cabinet door in the closed position.
Figure 17:
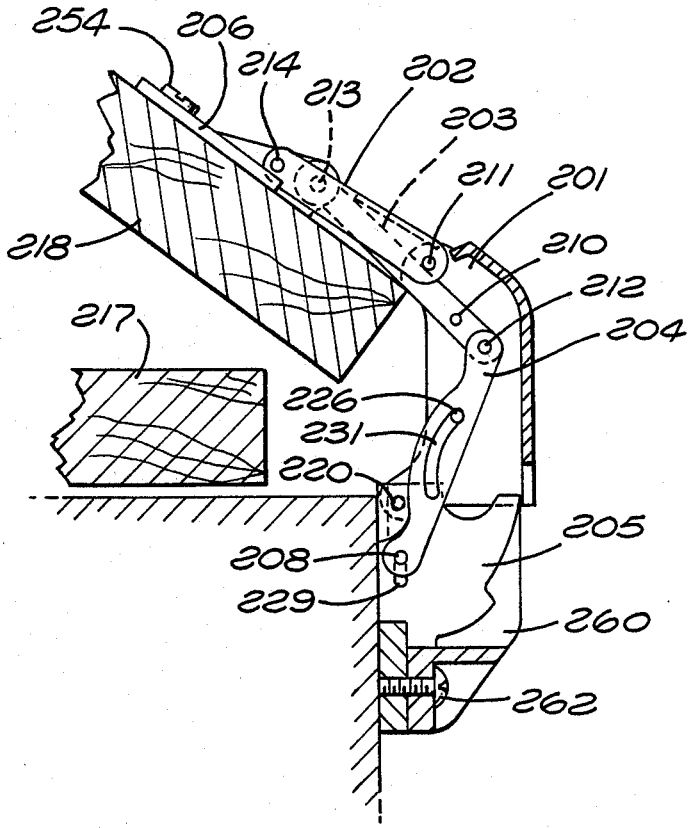
FIG. 17 is a similar view showing the door in the fully open position.

FIG. 16 is a side elevation of the hinge with the side portion of part 201 removed to show interior details. The door 218 is in the closed position. This hinge does not use the shifting pivot point at pivot point 13 of FIG. 2. The corresponding pivot point in FIG. 16 is designated by reference numeral 213, and many of the other parts in FIG. 16 and later figures are designated by the same reference numerals used in the parent case, but prefixed by a "2", or a "3" in the case of FIGS. 25–27. FIG. 17 is a side elevation of the same hinge with the side portion removed and with the door fully closed.

Figure 18:
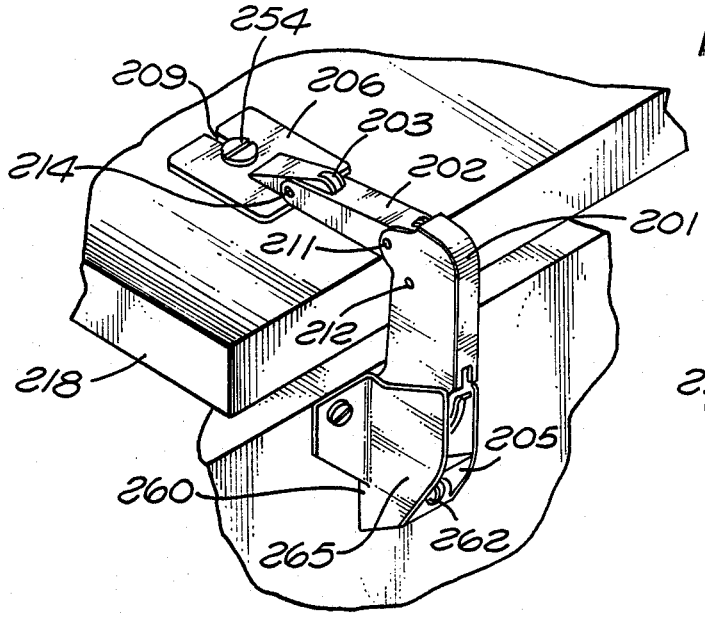
FIG. 18 is an isometric exterior view of the hinge of FIGS. 16 and 17 with the door fully open.

FIG. 18 is a perspective view of the hinge to illustrate how the part 206 can be attached to the door by one screw. It also shows the mounting plate 260 and other details.

Figure 19:
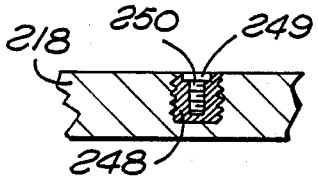
FIGS. 19 and 20 show two alternative single screw mounting arrangements.

FIG. 19 shows a plastic fitting 248 that is fastened to a door 218 and is shown in a sectional view.

Figure 20:
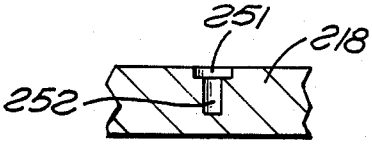

FIG. 20 shows a pilot hole 252, also in section.

Figure 21:
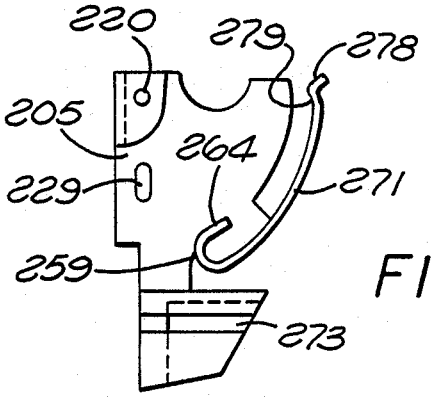
FIG. 21 shows the self-closing spring mechanism.
Figure 24:
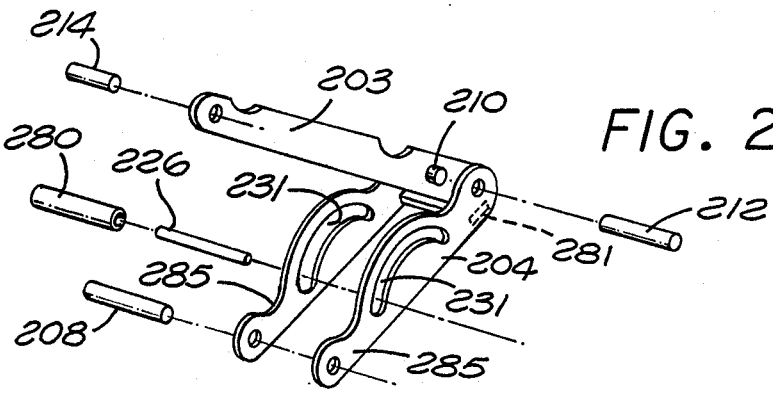
FIG. 24 is a cut-away view with certain parts shown separately, for clarity in indicating the mode of operation of the hinge.

FIG. 21 shows a side elevation of Part 5 to better illustrate a self-closing spring 271 attached to Part 5.

FIG. 22 shows a side elevation of an alternative embodiment of the hinge with the door 218 fully open and a direct non-shifting connection for Part 204.

FIG. 23 shows a side elevation of another alternative embodiment of the hinge, of the same type of hinge as FIG. 22 but where part 204 restrains and holds part 201 out of the vertical so that thicker doors may be used.

The changes and additions to the original hinges of FIGS. 1–13 will now be reviewed. The hinge shown in FIGS. 16 and 17 is basically similar to the hinge of FIGS. 1–13; however, the shifting pivot 13 of FIGS. 1–13 has been eliminated. As can be seen in FIG. 17, the pivot point 213 does not rise above the pivot points 214 and 211, but is approximately the same distance from the hinged door, and therefore, does not need to shift as in the first hinge version. By keeping the pivot point 213 almost in a horizontal line with pivot 214 as shown in FIG. 16, and moving the pivot points 211 and 210 further away from the surface of the door 218, FIG. 16, the proper reaction between the pivot points 211, 210, 213 and 214 is obtaines so that the door 218 when pulled or opened with shift away from the cabinet without touching the adjacent door 217 and the pivot point 213 will not extend beyond the pivot points 211 and 214 when said hinge is fully opened. The curved cut-out portion 231 of part 204 has its left end at about the same level as the right end as shown in FIG. 16; this prevents the rivet 208 of part 204 from going through a large arc. As can be seen in FIGS. 16 and 17, the vertical slot 229 of part 205 is quite short in length, as compared with the corresponding slot 29 in FIG. 2.

Upon full opening of the door, part 101 is restrained from rotating out of a vertical position by the rivet 208 of part 204 engaging the upper end of the slot 229 of part 205, and the rivet 226 of part 201 engaging the upper end of the channel 231 of part 204, and does not need the abutting surfaces 49 of part 1 bearing on part 5 as in the first hinge, as shown in FIG. 4. Rivet 226 could have a sleeve or bushing 280 over it to reduce sliding friction, see FIG. 24.

The part 205, FIG. 21, consists of a die casting that fits inside of part 201, and part 201 is pivotally riveted to it by two rivets 220. The mounting plate or bracket 260, FIG. 18, has the side plates or ears 265 cast as an integer portion of the plate 260. The part 205 is attached to the mounting bracket 260 by the screw 262. This is stronger, simpler and easier to manufacture than the arrangement shown in connection with the hinge of FIGS. 1–13.

FIG. 22 is a cut-away elevational view of an alternative embodiment of the hinge in a fully opened position. As can be seen, part 204 is connected directly to part 203 and then to part 205 with no connection to part 201.

With this invention there is no lock-up of the parts 202, 203, 206 and 201. In the first version as shown in FIGS. 1–13, the "lock-up" occurred as the door 18 was being rotated toward and away from the door 17 by the rotation of part 1, thereby allowing the door 18 to start its rotation or finish its rotation, depending on whether it was being closed or opened, at a distance from door 17, so that the two doors 17 and 18 did not come into contact. This lock-up principle is used in the hinge of FIGS. 1 to 13, and allows the hinge to be as small in size as possible. However, the hinge in FIG. 22 does accomplish the same reesult for all door styles, providing that part 201 and other parts are proportionately larger, so that the edges of door 218 do not strike the door 217 as the door rotates to its final opening angle. If the hinge is used for a spaced overlay style of door (FIGS. 22 and 23) or a lip style, the hinge size could be made in an acceptable size and the hinge would operate as described. Since there is no sliding motion of part 204 with part 205 and rivet 226, wear would be reduced, and by eliminating rivet 226, manufacturing costs would be reduced.

FIG. 23 shows a hinge with a similar construction to that of FIG. 22. However, the part 201 has been restrained at an angle out of the vertical (as shown in FIG. 23) by the part 4. This may be accomplished by lowering the location of pivot point 208, as shown in FIG. 23, as can be seen. The door 218 makes an angle of about 45 degrees with the face of the cabinet, or the door has opened about 135 degrees. This is a relatively wide opening angle and also provides a substantial clearance between the door 217 and door 218. This allows thicker doors to be used instead of $\frac{3}{4}$ inch or $\frac{7}{8}$ inch thick doors.

The hinge of FIGS. 16 and 17 could also be used in this manner by simply not moving the door to a full opening position; or a dowel or flat steel pin could be used to slide into the back of part 205 so that rivet 208 could not move upward in the slot 229 of part 205, thereby holding part 201 at the same angle as part 201 in FIG. 23.

FIG. 18 is a pictorial or isomertric view of the hinge. The view is primarily included to show how part 206 attaches to the door 218. The mounting bracket 260 and side pieces or ears 265 are also clearly shown. As can be seen, part 206 has an open-ended slot 209, in which a flat-headed screw 254 is positioned, for holding the part 206 in position on the door. The single screw mounting arrangement differs from the first hinge (see FIG. 1) which has two parallel slots, and the slots are closed at each end. This system of FIG. 18 allows the user to simply rotate and loosen the screw 254 to move the door 218 right or left to adjust it, and then retighten the screw instead of dealing with two screws. Also, if the user wanted to remove the door, all that would be necessary would be to loosen the one screw 204 and slide the entire door off. The screw 254 would be of a larger size than would be employed if two screws were used. This would be an advantage for companies that would remove the doors for shipping or transportation, since there would be no hinge protruding to scratch the other doors.

FIGS. 19 and 20 show two ways to prepare the door for the single screw 254. FIG. 19 shows a section of the door 218 and a section of a plastic pressed-in insert 248 with barbs or ferrules at its perimeter to hold it in. It has a hole 250 and a recessed larger hole or counterbore 249. The hole 250 has machine screw threads for a machine screw. This method might be ideal for large companies that use drilling and insertion machines so that the plastic fitting would be installed automatically.

FIG. 20 shows a section of a pilot hole 252 and a recessed larger hole or counterbore 251. This hole could be drilled by an insertion type machine or a drill press or hand drill. In both of these versions, the larger recessed hole is provided so that when the door is removed, the screw can be turned all the way down, and the surface of the screw will be below the surface of the door, preventing it from scratching other doors.

FIG. 21 shows part 205 separately to better view the spring 271, which provides self-closing action. Spring 271 is a flat-steel spring. The spring has a curved portion 259 for resilience, a straight portion 264 that is pressed into a matching channel of part 205 to secure it in place.

There is an angled portion 279 tht bears against a matching downwardly deflected portion in part 202, thereby providing self-closing action for the hinge. The outwardly deflected portion 278 allows a matching portion of part 202 to deflect the spring 271 outwardly until a similar matching portion of part 202 is in the angled area 279 of spring 271, and the spring 271 can then hold part 202 in a closed position.

Figure 25:
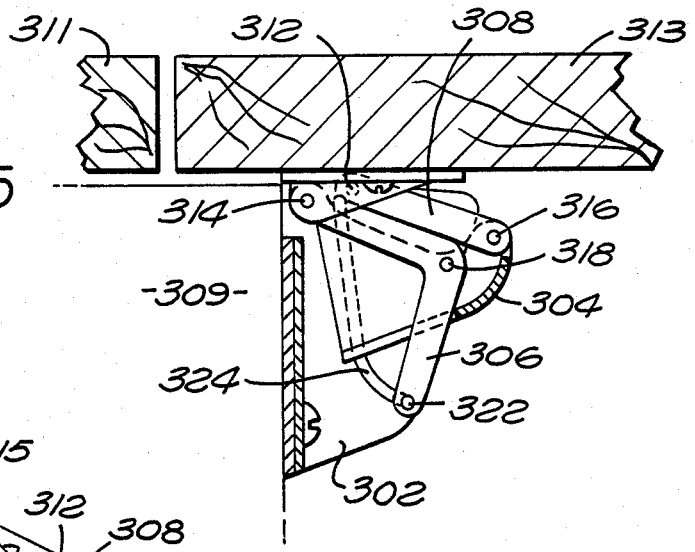
FIGS. 25 through 27 show improved versions of the hinge shown in FIGS. 14 and 15 of the parent case.
Figure 26:
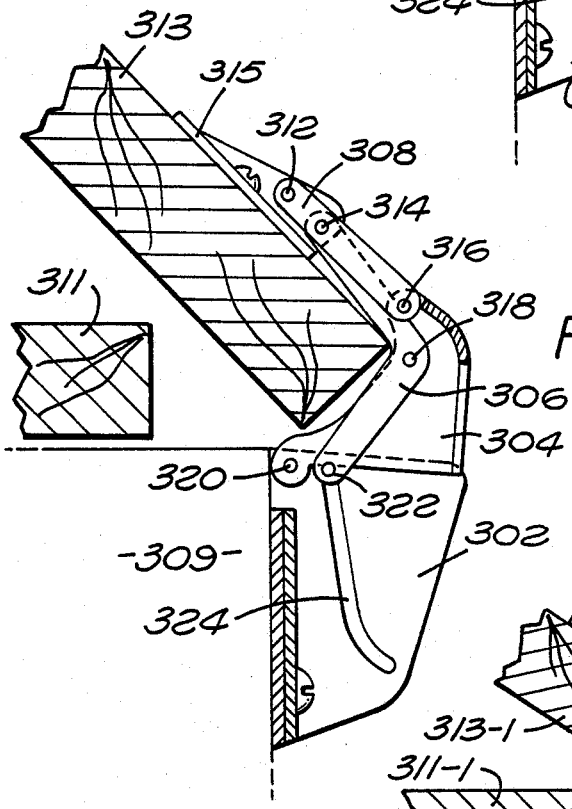

FIGS. 25 and 26 are side elevational views of an improved embodiment of the hinge that is shown in FIGS. 14 and 15 of the original patent application. The reference numerals used in the embodiment of FIGS. 25 and 26 correspond generally to those used in FIGS. 14 and 15, but are prefixed with a "3". The door 313 opens under the control of the rotating part 304, controlled by the straight linkage 308 and the L-shaped linkage 306 having a cam follower rivet 322 in channel 324.

FIGS. 25 and 26 show the hinge in the closed and the fully opened positions respectively. As can be seen in FIG. 26, the hinge and attached door 313 is opened to about a 135 degree opening angle where the hinge shown in FIG. 15 only opens to approximately 100 degrees. The wider opening angle of the hinge in FIGS. 25 and 26 is obtained by moving the pivot point 314 very close to the bottom side of the door 313 as shown in FIG. 25, similar to the arrangements of FIGS. 16–24, and lowering the pivot points 316 and 318 below the bottom of the door 313, and also extending the leg of part 306 that has the pin 322 attached. It may be noted in passing that the pivot point 320 for part 304 is shown in FIG. 26, but is substantially aligned with pivot point 314 for L-shaped linkage 306 in FIG. 25.

These changes allow a greater angle between the pivots 314, 318 and 322 of part 306. When the door is fully opened, the pivot 314 lines up with pivots 316 and 312 and the pin 322 of part 306 is engaged at the top of channel 324. The door 313 then lies parallel to the part 308 as seen in FIG. 26.

Figure 27:
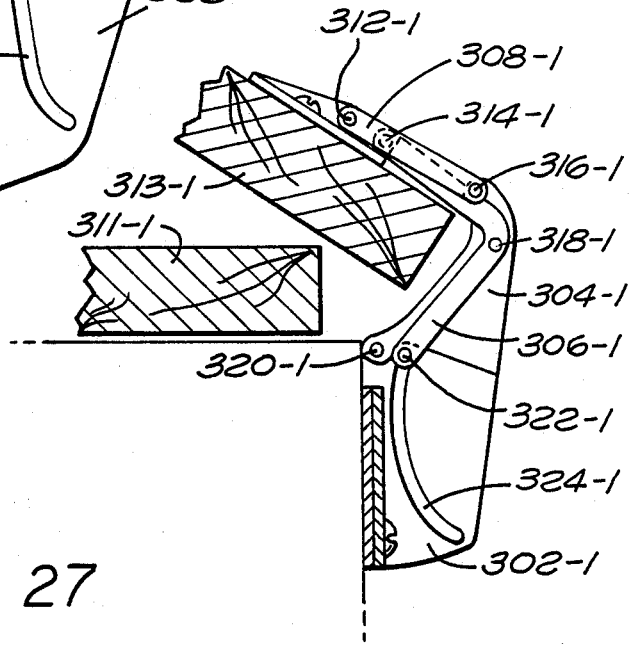

The 135 degrees version shown may also be made into a full opening version as shown in FIG. 27 by making the main rotating structural member 301-1 longer and part 302-1 wider, so that channel 324-1 engages the pin 322-1 of L-shaped linkage 306-1. The leg of part 306-1 with the pin 322-1 is also made longer. To indicate more quantitatively, the nature of the change, the horizontal distance between points 314 and 316 as shown in FIG. 25 would be in the order of $1\frac{3}{8}$ inches; while in the full opening embodiment of FIG. 27, the distance between corresponding pivot points 314-1 and 316-1 would be in the order of $1\frac{3}{8}$ inches when the door bracket is in the closed configuration.

The hinges shown in FIGS. 14, 15, 25, 26 and 27 could have a roller that is forced by spring action to bear against the pin 322 of part 306 when the part 322 is near the bottom end of channel 324, thereby providing self-closing spring arrangements for these hinges. Refering to FIG. 25, for example, the spring force on pin 322 would force pin 322 toward the end of the channel.

Incidentally, the operative parts of the hinges of FIGS. 25 through 27, such as parts 302, 304, 308 may be double parts of additional strength, or may be single sided structural parts or stampings, for lower cost embodiments.

In conclusion, it is to be understood that the disclosed embodiments are merely illustrative of the principles of the invention, and that the invention could be implemented by alternative constructions. Thus, by way of example and not of limitation, the pivoting movement of the pivoted housing or main structural member could be controlled by alternative known mechanical linkages instead of the pin and groove mechanisms disclosed hereinabove. In addition, the part 2 could be implemented by a pair of arms instead of a U-shaped member (including the two arms) as disclosed herein. Further, the mounting bracket adjustments could be accomplished in different known ways. In addition, in some instances the cabinet and door brackets may be reversed, although the described arrangements are normally preferred. Accordingly, the present invention is not limited to the precise constructins shown in the drawings and described in the foregoing detailed description.

What is claimed is:

1. A surface mounted fully concealed cabinet hinge assembly comprising:

a door bracket;

means for mounting said door bracket flush on the surface of a cabinet door;

a cabinet bracket;

means for mounting said cabinet bracket flush to the surface of a cabinet structural member;

a main rotating structural member pivotally mounted to said cabinet bracket;

parallelogram structural means interconnecting said door mounted bracket with said main pivotally mounted member to provide initial substantially parallel movement of said door relative to said main structural member;

means for controlling the rotation of said main structural member relative to said cabinet bracket;

means coupled to said parallelogram structural means and said controlling means for initially delaying substantial rotation of said main structural member and, following partial operation of said parallelogram member, and clearance of the door from adjacent structure permitting substantial pivotal movement of said main structural member; and said parallelogram structural means including two linkage members having two respective respective pivot means securing said linkage members to said door bracket, with both of said two pivot means being spaced substantially side-by-side along said door bracket, and the surface of the door; said two pivot means are located substantially the same distance from said door.

2. A hinge assembly as defined in claim 1 wherein said two pivot means are located substantially in a plane parallel to the door.

3. A hinge assembly as defined in claim 1 wherein means are provided for mounting said door bracket onto said door with a single screw.

4. A hinge assembly as defined in claim 3 wherein said door bracket has an open ended slot for receiving said single screw.

5. A hinge assembly as defined in claim 1 including spring means for automatically closing a door mounted on said hinge.

6. A surface mounted fully concealed cabinet hinge assembly as defined in claim 1 wherein said means coupled to said parallelogram means includes a camming groove and follower.

7. A surface mounted fully concealed cabinet hinge assembly as defined in claim 1 wherein said controlling means includes an extension on one of said linkage members beyond the pivot point of said arm with said pivotally mounted main structural member.

8. A surface mounted fully concealed cabinet hinge assembly as defined in claim 1 wherein said cabinet mounted bracket includes a camming groove, and wherein one of said linkage members includes an extension having a cam follower therein for engaging said camming groove.

9. A surface mounted fully concealed cabinet hinge assembly as defined in claim 1 including means for adjustably mounting each of said brackets.

10. A surface mounted fully concealed cabinet hinge assembly as defined in clim 1 wherein said means coupled to said parallelogram structural means includes a separate linage member pivotally connected to one of said arms and mechanically linked to both said main rotating structural member and to said cabinet bracket.

11. A hinge assembly as defined in claim 1 wherein said linkage members are angled at an acute angle outward away from said door toward their pivot points with the main pivotally mounted member, when the door hinge is in the closed configuration.

12. A hinge assembly as defined in claim 1 wherein the greater distance from the door bracket mounted pivot point of one of said linkage members to the nondoor bracket mounted pivot point of the other linkage member is greater than one and one-half inch.

13. A surface mounted fully concealed cabinet hinge assembly comprising:

a door bracket;

means for mounting said door bracket flush on the surface of a cabinet door;

a cabinet bracket;

means for mounting said cabinet bracket flush to a vertical surface of a cabinet structural member, said surface being generally parallel to the axis of rotation of the door;

a main rotating structural member pivotally mounted to said cabinet bracket at a fixed pivot point;

parallelogram structural means interconnecting said door mounted bracket with said main pivotally mounted member, with at least one linkage forming part of said means being fixedly pivoted to said door bracket at one point, and fixedly pivoted to said main rotating structural member at another point;

means for controlling the rotation of said main structural member relative to said cabinet bracket;

means coupled to said parallelogram structural means and said controlling means for initially delaying substantial rotation of said main structural member and, following partial operation of said parallelogram member, and clearance of the door from adjacent structure permitting substantial pivotal movement of said main structural member;

said parallelogram-type structural means including at least two linkages pivotally mounted to the door bracket member at the end of each linkage which is closer to the edge of the door, and to the pivotally mounted structural member at the end of each said linkage which is further away from the edge of the door; and the pivot points between said linkages and said door bracket being located side-by-side along said door bracket and the adjacent surface of said door; said two pivot means are located substantially the same distance from said door.

14. A hinge assembly as defined in claim 13 wherein means are provided for mounting said door bracket onto said door with a single screw.

15. A hinge assembly as defined in claim 13 wherein the greater distance from the door bracket mounted pivot point of one of said linkages to the nondoor bracket mounted pivot point of the other linkage is greater than one and one-half inch.

16. A surface mounted fully concealed cabinet hinge assembly comprising:

a door bracket;

means for mounting said door bracket flush on the surface of a cabinet door;

a cabinet bracket;

means for mounting said cabinet bracket flush to the surface of a cabinet structural member;

a main rotating structural member pivotally mounted to said cabinet bracket;

parallelogram structural means interconnecting said door mounted bracket with said main pivotally mounted member;

means for controlling the rotation of said main structural member relative to said cabinet bracket;

means coupled to said parallelogram structural means and said controlling means for initially delaying substantial rotation of said main structural member and, following partial operation of said parallelogram member, and clearance of the door from adjacent structure, permitting substantial pivotal movement of said main structural member;

said parallelogram-type structural means including at least two linkages being pivotally mounted to the door bracket member at the end of each linkage which is closer to the edge of the door, and to the pivotally mounted structural member at the end of each said linkage which is further away from the edge of the door; and the pivot points between said linkages and said door bracket being located side-by-side along said door bracket and the adjacent surface of said door; said two pivot means are located substantially the same distance from said door.

17. A hinge assembly as defined in claim 16 wherein said two pivot means are located substantially in a plane parallel to the door.

18. A hinge assembly as defined in claim 16 wherein said door bracket has an open ended slot for receiving said single screw.

19. A hinge assembly as defined in claim 16 wherein the greater distance from the door bracket mounted pivot point of one of said linkages to the nondoor bracket mounted pivot point of the other linkage is greater than one and one-half inch.

* * * * *